United States Patent [19]

Andreoli

[11] 4,212,350

[45] Jul. 15, 1980

[54] MODULAR ELEMENT RADIATOR-CONVECTOR

[76] Inventor: Mario Andreoli, Via dello Sterlino, 16, Bologna, Italy

[21] Appl. No.: 674,268

[22] Filed: Apr. 6, 1976

[30] Foreign Application Priority Data

Apr. 11, 1975 [IT] Italy ..... 4763/75[U]
May 6, 1975 [IT] Italy ..... 3402 A/75

[51] Int. Cl.[2] ..... F24H 3/00; F28F 1/12
[52] U.S. Cl. ..... 165/129; 165/122
[58] Field of Search ..... 165/129, 131, 121, 122, 165/128, 171

[56] References Cited

U.S. PATENT DOCUMENTS

| | | | |
|---|---|---|---|
| 446,580 | 2/1891 | Fowler | 165/129 |
| 1,829,241 | 10/1931 | Shurtleff | 165/129 |
| 1,903,125 | 3/1933 | Modine | 165/129 X |
| 2,229,128 | 1/1941 | Reynolds | 165/129 X |
| 3,470,352 | 9/1969 | McKay et al. | 165/129 |
| 3,592,260 | 7/1971 | Berger | 165/121 |
| 3,774,680 | 11/1973 | Andreoli | 165/128 X |
| 3,867,981 | 2/1975 | Monroe | 165/129 X |

FOREIGN PATENT DOCUMENTS

| | | | |
|---|---|---|---|
| 509170 | 2/1952 | Belgium | 165/129 |
| 665402 | 6/1963 | Canada | 165/129 |
| 1915629 | 1/1970 | Fed. Rep. of Germany | 165/129 |
| 1254959 | 12/1961 | France | 165/129 |
| 324596 | 11/1957 | Switzerland | 165/129 |
| 729554 | 5/1955 | United Kingdom | 165/129 |

*Primary Examiner*—Sheldon Richter
*Attorney, Agent, or Firm*—Guido Modiano; Albert Josif

[57] ABSTRACT

A radiator-convector comprising a plurality of modular elements which are assembled to one another and comprise each a pair of hollow and parallel sleeves. A plate extends in a perpendicular plane to the plane whereon said sleeve axes lie. The laminar rib is integral with the sleeves. Substantially parallel oblique fins extend from the opposed faces of the plate and obliquely with respect to the sleeve axes lying plane. The plate is further provided on its front edge with front fins which, when the modular elements are assembled, define a front wall and define, with the plate of adjacent elements, vertical channels whereto oblique channels open which are defined by the oblique fins.

2 Claims, 9 Drawing Figures

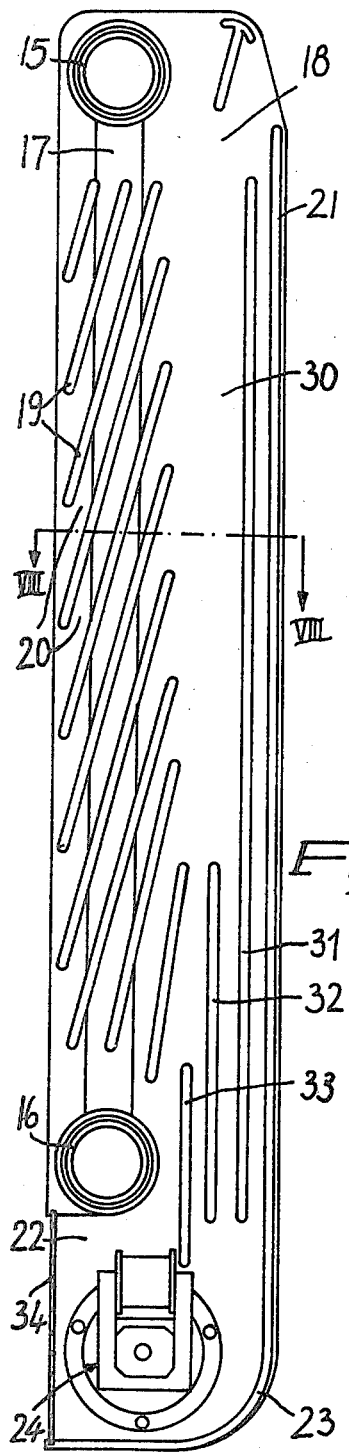
Fig. 5
Fig. 9
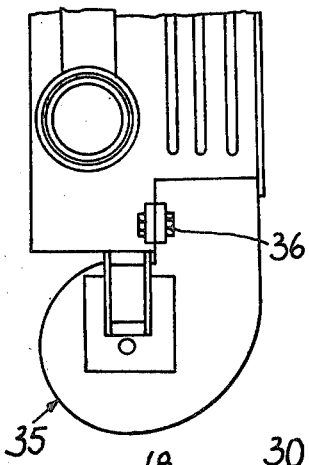
Fig 6
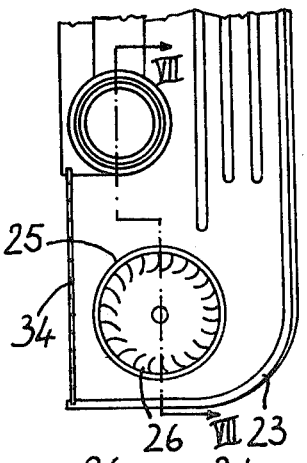
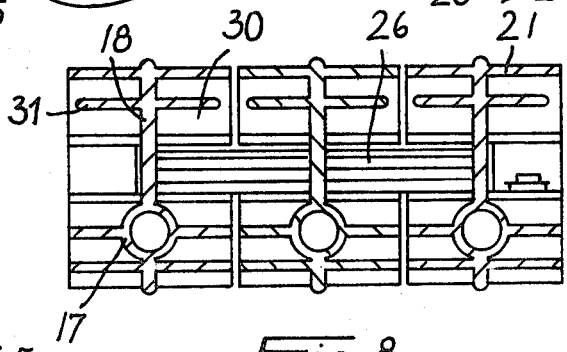
Fig. 8
Fig. 7
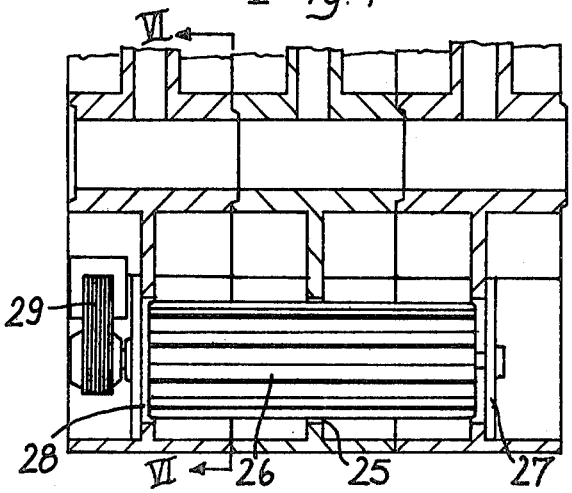

MODULAR ELEMENT RADIATOR-CONVECTOR

BACKGROUND OF THE INVENTION

This invention relates to a radiator-convector comprising a plurality of assembled modular elements.

In the prior art radiator-convector, the circulation of air is mainly dependent on the ascensional thrust the air is subjected to when being heated. That air ascensional thrust, deriving from the density difference between the heated air and surrounding air, is, however, limited. It thus occurs that, when the ascending air stream, previously heated to a large extent in the radiator bottom portion, reaches the radiator upper portion, it presents a somewhat reduced thermal gradient with respect to the radiator, with consequent reduction in the heat exchange rate. Thus, a thermal saturation condition is arrived at which reduces the radiator effectiveness.

In order to obviate such a shortcoming, radiators have been proposed (West German Pat. No. 838,647) wherein the fins are inclined from the vertical. In such radiators, air flows obliquely through the radiator, whereby, between that same air and the surface licked by it, there should be maintained an appreciable thermal gradient, thereby said thermal saturation phenomenon should be eliminated. In actual practice, however, that oblique arrangement of the fins proved to hinder the air rising motion, whereby the saturation effect is not completely eliminated.

SUMMARY OF THE INVENTION

It is a primary object of this invention to optimize the efficiency of a radiator-convector as mentioned above, by constructing the radiator-convector unit such as to favor the convective effect and minimize the thermal saturation phenomena.

The above cited object is achieved according to the invention by radiator-convector comprising a plurality of assembled modular elements each of which comprises an upper sleeve member, a lower sleeve member parallel to said upper sleeve member, a plate cast integral with said sleeve members and perpendicular to a plane passing through said sleeve members, said plate having a front edge and rear edge, a conduit formed in said plate and connecting said upper sleeve member with said lower sleeve member, fins extending from the opposite sides of said plate and comprising substantially parallel fins obliquely arranged with respect to said plane and front fins provided at the front edge of said plate and forming a front wall, said front fins and the plate of adjacent elements when assembled defining air ducting vertical channels each having a lower inlet opening and an upper outlet opening and said parallel fins defining air ducting oblique channels, wherein according to the improvement said oblique channels have their lower ends open at the rear edges of said plates and their upper ends communicating with said vertical channels and wherein at the inlet openings of said vertical channels ribs are arranged which converge towards said channels.

BRIEF DESCRIPTION OF THE DRAWING

Further features of the invention will be more apparent from the ensuing detailed description with reference to the accompanying drawings, where:

FIG. 5 is an elevational view of a modular element according to yet another embodiment of the invention;

FIG. 6 is a sectional view taken along the line VI—VI of FIG. 7;

FIG. 7 is a sectional view taken along the line VII—VII of FIG. 6;

FIG. 8 is a sectional view taken along the line VIII—VIII of FIG. 5 rotated clockwise by 90°; and FIG. 9 shows the lower portion of a radiator-convector unit according to a further embodiment of the invention.

DESCRIPTION OF PREFERRED EMBODIMENTS

Figure 1:
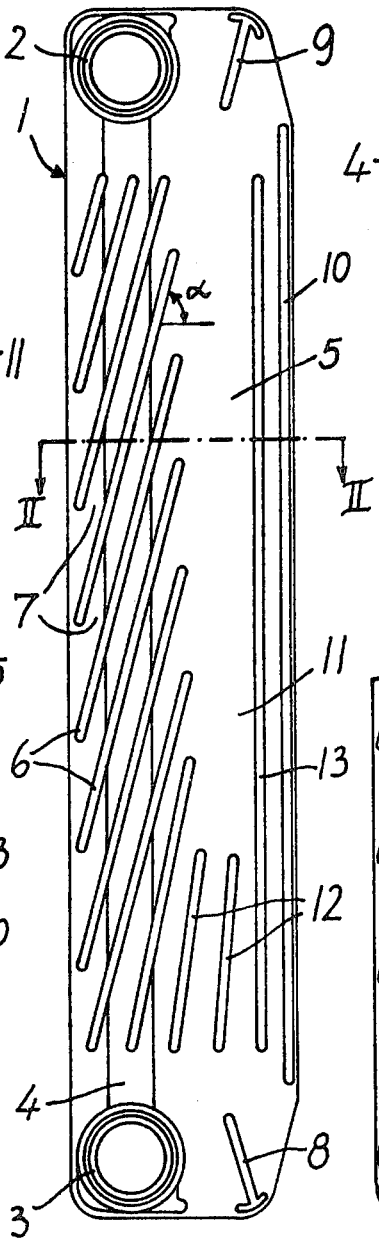
FIG. 1 is an elevational view of a modular element according to a first embodiment of the invention.
Figure 2:
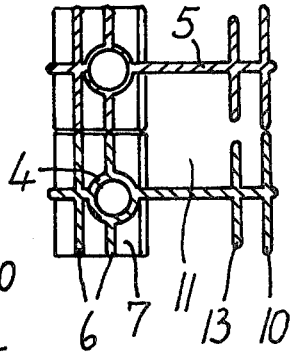
FIG. 2 is a sectional view taken along the line II—II of FIG. 1.

With reference to FIGS. 1 and 2, the numeral 1 identifies generally one of the modular elements which make up a radiator-convector unit according to the invention. The element 1 comprises two sleeves 2, 3 parallel to each other and interconnected together by means of a conduit 4. The front ends of the sleeves 2, 3 are provided, in a known manner, with annular projections on one side, and annular seats complementary to said projections on the other side. The projections may be fitted in the seats thus enabling coupling together of two or more elements, by locking them to each other through tie rods led through the sleeves 2, 3, according to a conventional technique, or through nipples, provided with opposite-handed threads and screwed into the aligned sleeves of adjacent elements.

In the centerplane, perpendicular to the sleeves 2, 3 and cast therewith, plate 5 is provided which is perpendicular to a plate passing through the sleeve members 2, 3. On the opposite faces of the plate 5, in the area included between the sleeves 2, 3, a plurality of fins 6 are provided having the same width extension and being parallel to one another. The fins 6 are perpendicular to the plate 5 and arranged obliquely with respect to the plane passing through the sleeve 2, 3. Preferably, the angle $\alpha$ (alpha) included between the fins 6 and the plane perpendicular to the conduit 4 is approximately of 75°. The fins 6, when the various radiator elements are assembled, form, together with the fins of adjacent elements, oblique channels 7 the air intake wherefor is located on the radiator rear face, i.e. on the face intended to be facing the building wall, whereas the exhaust is arranged on the front face. The oblique channels are inclined such that the air intake in one channel is at a lower level than the exhaust.

Advantageously, for directing the air flow, there is provided at the lower sleeve a front fin 8, while at the upper sleeve 2 a further front fin 9 is provided. The plate 5 comprises an area which projects forward beyond the front ends of the oblique fins 6. Perpendicularly to said area and on both faces of the plate 5, are fins 10 rigid therewith in the proximity of the front edge, and which extend almost over the full height of the radiator between the sleeves 2, 3. The fins 10 have the same side width as the fins 6, whereby, when the modular elements are assembled together, they form the visible front wall of the radiator-convector and define vertical channels 11 for leading the rising air stream.

Ribs 12 and converging toward the channel 11, are provided at the lower air intake. The reference numeral 13 identifies fins arranged just behind the front fins 10 and substantially parallel to the latter. The fins 13 have a smaller width than the fins 10, so that in assembled condition an interspace is defined between the opposite edges of fins belonging to adjacent elements which favors a turbulent circulation for the rising air. Advantageously, the distance of the oblique fin 6 upper ends from the front wall defined by the fins 10 is gradually increasing from bottom to top (see FIG. 1). In this manner, the channel 11 is enabled to receive the air convoyed thereto by the oblique channels 7, since the air flow increases as it moves upwards.

It is of essential importance that, in the described radiator, the air flow along the channel 11 has a draft effect, thus drawing in more air from the oblique channels, eliminating the thermal saturation as mentioned and increasing the unit efficiency. With the described elements, contrary to what happens usually in the prior art radiators, the water inlet may be provided at the lower manifold formed by the lower sleeves 3 and the water outlet at the upper one formed by the upper sleeves 2. In fact in the lower portion of the radiator a greater heat exchange occurs, which increases the convective capacity of the radiator and causes a greater rising velocity for the air as well as a greater draft through the oblique fins.

Figure 3:
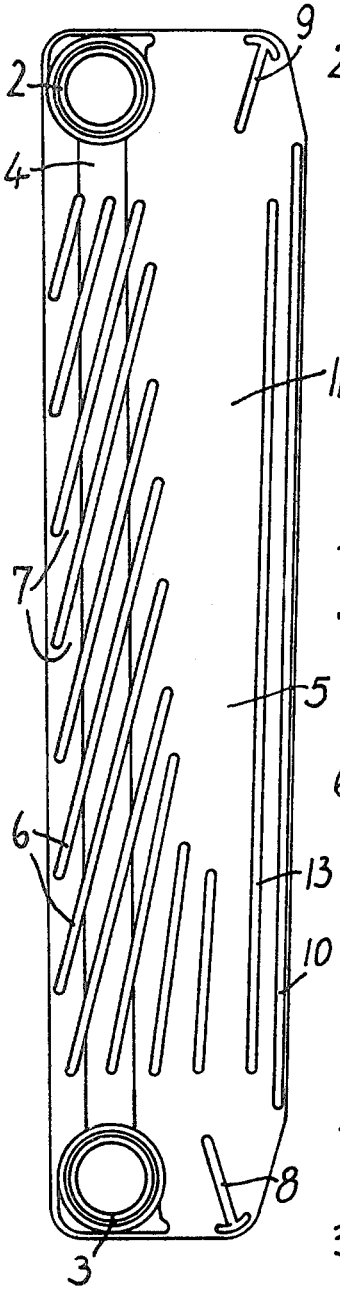
FIG. 3 is an elevational view of a modular element according to a further embodiment of the invention.
Figure 4:
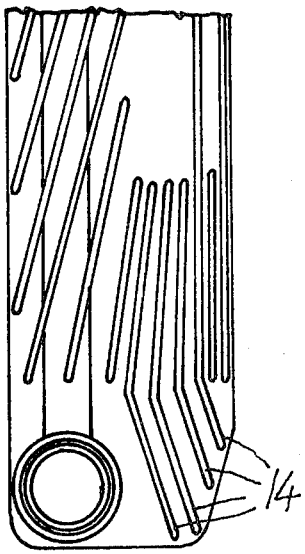
FIG. 4 is a view of a variation of the modular element lower portion.

In the embodiment of FIG. 4 the air lower intake is provided with a greater number of ribs 14, the lower portions whereof are bent forward and terminate at the inclined lower front edge of the plate 5. The increasing cross-section, from bottom to top, of the vertical channel II, rather than being obtained by providing shorter oblique fins as shown in FIG. 1, may be obtained with oblique fins of equal length, by arranging the front wall slightly inclined forward, as shown in FIG. 3.

In the embodiment shown in FIG. 5, the upper sleeve 15 and lower sleeve 16 are interconnected by a conduit 17 and a plate 18. The oblique fins 19 extend from opposite faces of the plate 18 which, when the modular elements are brought together, define the oblique channels 20. The plate 18 comprises a portion 22 extending beneath the lower sleeve 16 and the fin 21 which is provided along the front edge of the plate 18 and projects perpendicularly from both faces of the plate 18, defines, at the portion 22 an arc 23 which forms the housing of an axial fan indicated generally at 24. A circular opening 25 is formed in the portion 22, adapted to accomodate therethrough the drumlike impeller 26 of the fan 24. The impeller 26 has its ends supported on flanges 27 and 28 fastened by means of screws to the portion 22 of the side elements. Advantageously, the fan motor 29 is housed in a seat defined laterally to the portion 22. As it will be noted from FIG. 5, within the vertical channel 30 acting as a draft channel for the rising air, further exchange fins 31, 32 are provided, the former fin being effective to induce a greater turbulence, and the latter to increase the exchange surface area at intake of the vertical channels. The radiator in FIG. 5 is completed by a vertical fin 33 the lower end whereof defines, together with the opposite portion of the fin 21, the fan outlet port which, accordingly, is aligned with the vertical channel 30.

In order to prevent the fouling of the radiator with dirt or other particles, at the rear sides of the radiator, and facing the intake port for the fan 24, there is provided an air filter 34 comprising a fine mesh screen or other suitable material.

It will be apparent how the directing of air along the channel 30 results, on one side, in a powerful heat exchange at the lower portion of the radiator which is provided with more fins, and on the other side, in a greater draft effect on the air through the oblique channels 20.

In the embodiment of FIG. 9, the fan housing is not cast integral in the radiator element, and is rather a component part of the fan itself. The fan, identified with the numeral 35, is mounted directly to the lower part of the radiator in a specially provided seat and secured by means of bolts 36 passed through ear flanges formed in the blower housing and modular elements.

According to a further embodiment of the invention, the air flow, rather than being produced by a fan impeller blowing from below through the radiator, as shown in FIG. 5, is accomplished through a fan arranged at the top of the radiator and sucking air.

In practicing the invention, the elements which form the radiator have a monolithic structure and are made by die-casting of light alloys.

I claim:

1. A radiator-convector comprising a plurality of assembled modular elements each of which comprises an upper sleeve member, a lower sleeve member parallel to said upper sleeve member, a plate cast integral with said sleeve members and perpendicular to a plane passing through said sleeve members, said plate having a front edge and rear edge, a conduit formed in said plate and connecting said upper sleeve member with said lower sleeve member, fins extending from the opposite sides of said plate and comprising substantially parallel fins obliquely arranged with respect to said plane and front fins provided at the front edge of said plate and forming a front wall, said front fins and the plate of adjacent elements when assembled defining air ducting vertical channels each having a lower inlet opening and an upper outlet opening and said parallel fins defining air ducting oblique channels, wherein according to the improvement said oblique channels have their lower ends open at the rear edges of said plates and their upper ends communicating with said vertical channels and wherein at the inlet openings of said vertical channels ribs are arranged which converge towards said channels.

2. A radiator-convector as claimed in claim 1 wherein said plates comprise a portion extending beneath said lower sleeve member and provided with a circular opening, the front fins which form the front wall extending on said portion according to an arc partially surrounding said circular opening thus defining, when the elements are assembled, a housing for a fan having a drum like impeller arranged through said openings and rotatably supported on flange members secured to said portions, the outlet of said fan being aligned with said vertical channels.

* * * * *